US005778839A

United States Patent [19]

Speil

[11] Patent Number: 5,778,839

[45] Date of Patent: Jul. 14, 1998

[54] FINGER LEVER FOR ACTUATING A GAS EXCHANGE VALVE

[75] Inventor: Walter Speil, Ingolstadt, Germany

[73] Assignee: Ina Wälzlager Schaeffler KG, Herzogenaurach, Germany

[21] Appl. No.: 911,114

[22] Filed: Aug. 14, 1997

Related U.S. Application Data

[63] Continuation of Ser. No. 704,763, Sep. 26, 1996, abandoned.

[30] Foreign Application Priority Data

Apr. 14, 1994 [DE] Germany ..... 9406211 U

[51] Int. Cl.[6] ..... F01L 13/00; F01L 1/18

[52] U.S. Cl. ..... 123/90.16; 123/90.41; 123/198 F; 74/519; 74/559

[58] Field of Search ..... 123/90.15, 90.16, 123/90.39, 90.41, 90.44, 198 F; 74/519, 559

[56] References Cited

U.S. PATENT DOCUMENTS

| | | | |
|---|---|---|---|
| 4,726,332 | 2/1988 | Nishimura et al. | 123/90.16 |
| 5,357,916 | 10/1994 | Matterazzo | 123/90.16 |

FOREIGN PATENT DOCUMENTS

| | | |
|---|---|---|
| 2 535 390 | 5/1984 | France . |
| 32 43 897 C2 | 9/1983 | Germany . |
| 37 35 589 A1 | 5/1989 | Germany . |
| 40 33 688 A1 | 4/1992 | Germany . |
| 42 10 143 A1 | 10/1992 | Germany . |
| 42 37 777 A1 | 5/1993 | Germany . |
| 94 06 190 | 6/1994 | Germany . |

OTHER PUBLICATIONS

JP.A.60 150413 (Mitsubishi Jidosha Kogyo KK), Aug. 8, 1985.

*Primary Examiner*—Weilun Lo
*Attorney, Agent, or Firm*—Henry M. Feiereisen

[57] ABSTRACT

A valve actuating mechanism which can be set to three different strokes for a gas exchange valve includes a finger lever actuated by a control cam with a single lift curve, with the finger lever being selectively connectable to a longitudinal guide in the region of its bearing member via incorporation of a piston that is movable in various positions. In a first coupling position of the piston, the bearing member is fixed to the longitudinal guide so that the finger lever executes a maximum pivot during the lift phase of the cam. In a second coupling position of the piston the finger lever is moved axially along the longitudinal guide during a complete cam lift so that the opening cross section of the gas exchange valve is smaller than in the first coupling step. In a third coupling step of the piston, the finger lever executes an idle stroke-pivoting movement on its point of contact on the gas exchange valve which remains closed.

9 Claims, 1 Drawing Sheet

FINGER LEVER FOR ACTUATING A GAS EXCHANGE VALVE

This is a continuation of application Ser. No. 08/704,763, filed Sep. 26, 1996, now abandoned.

BACKGROUND OF THE INVENTION

The invention concerns a finger lever for actuating at least one gas exchange valve in a valve drive of an internal combustion engine, which finger lever is arranged in driving relationship between a control cam and the gas exchange valve and is contacted preferably in a central region by the control cam, the finger lever acting at one end in lifting direction on the gas exchange valve while being pivoted at another end on a cylinder head of the internal combustion engine by a bearing means.

A cam follower of this type, known from DE-A 41 18 287, is a two-piece finger lever which is contacted by two cams having different contours for obtaining different valve lifts. A drawback of this generic type of structure is that two finger levers actuated by two control cams are required for obtaining different valve lifts in the gas exchange valve concerned. The structure of such a valve actuating device is thus rather complicated.

SUMMARY OF THE INVENTION

The object of the invention is therefore to create a device of the initially cited type in which the aforesaid drawbacks are eliminated and with which, particularly, different valve lifts can be obtained with a valve drive of simple structure.

This object is attained in accordance with the present invention by selectively connecting the finger lever to a longitudinal guide in the region of its bearing member via incorporation of a piston that is movable in various positions for effecting different lifts of a gas exchange valve, wherein in a first coupling position of the piston, the bearing member is fixed to the longitudinal guide so that the finger lever executes a maximum pivot during the lift phase of the cam, in a second coupling position of the piston, the finger lever is moved axially along the longitudinal guide during a complete cam lift so that the opening cross section of the gas exchange valve is smaller than in the first coupling step, and wherein in a third coupling step of the piston, the finger lever executes an idle stroke-pivoting movement on its point of contact on the gas exchange valve which remains closed.

The finger lever which is contacted by a control cam having a single lift contour is connected by the bearing member at least indirectly to the longitudinal guide which extends generally parallel to the longitudinal axis of the gas exchange valve;

Coupling means associated to the finger lever couple a bearing block, in which the bearing member is arranged, to the longitudinal guide in such a way in a first coupling step that, during the lift phase of the cam, the finger lever executes a maximum pivot about the being means which is now fixed on the longitudinal guide;

In a second coupling step of the coupling means, the bearing block is coupled to the finger lever by the coupling means in such a way that the bearing block and the finger lever execute a common axial movement along the longitudinal guide during a complete cam lift, the opening cross-section of the gas exchange valve obtained during the cam lift being smaller than in the first coupling step;

In a third coupling step of the coupling means, the bearing block is uncoupled from the longitudinal guide, and the finger lever is uncoupled from the bearing block so that the finger lever executes an idle stroke-pivoting movement on its point of contact on the gas exchange valve which remains closed.

A finger lever in accordance with the present invention thus makes it possible to obtain at least two different valve lifts with one finger lever which is contacted only by one control cam having only one lift contour. By the alternative, third coupling step, an additional idle stroke of the device as a whole is obtained so that the gas exchange valve remains closed in the manner desribed above. This latter feature is particularly intended for switching off valves in internal combustion engines equipped with multi-valve technology especially during partial load or idling operation of the engine. The present configurations can be implemented on conventional finger levers and camshafts. The invention also covers the provision of further coupling steps by fixing the finger lever at a pre-determined height on the longitudinal guide in the manner described in the first coupling step. Further valve lifts can be achieved by providing coupling steps for the coupling means spaced over the height of the bearing block and/or of the finger lever. It is also conceivable to realize a cam contact on the finger lever by a roller-type or similar contact, not shown, but it is equally possible to use a sliding contact.

According to another feature of the invention recited, the longitudinal guide is made as a column fixed rigidly on the cylinder head of the internal combustion engine and extending in cam direction while being surrounded by the bearing block which is axially displaceable thereon. The bearing block and the finger lever each comprises a bore parallel to the bearing means and these bores, in which a longitudinally displaceable coupling means made as a piston is arranged, are aligned to each other in one position of pivot of the finger lever relative to the bearing block, preferably in a base circle phase of the cam. The column on which the bearing means is guided can have any geometric configuration. By its function as a longitudinal guide, the column guarantees the lifting stroke of the finger lever in accordance with the second coupling step. This lifting stroke corresponds to the maximum pitch of the control cam and is smaller than the lifting stroke of the finger lever obtained during the first coupling step due to the different ratio of multiplication.

Advantagously, the piston is actuated, in a manner not further specified here, by hydraulic medium from the cylinder head and can be biased in one of its directions of displacement by a mechanical spring. However, it is also conceivable to operate the piston by mechanical, electromechanical, magnetic or other suitable means, or to use combinations of such actuating methods. In the third coupling step, the finger lever is retained in its pivoted, bottom dead center position so that it is at least partially out of contact with the control cam. This retention of the piston is also effected by the initially described coupling means. These measures lead to an additional reduction of friction in the valve drive of the invention.

According to another feature of the invention, an "idling space" is provided in the bearing block for the piston acting as a coupling means. This idling space is a simple measure which assures the pivoting movement of the finger lever on its point of contact on the gas exchange valve whereby the alternative coupling step is realized. However, it is also conceivable to integrate the coupling piston entirely in the bore of the finger lever to effect this operational state.

Suitably, the bearing block is supported on the cylinder head by at least one compression spring. This compression spring guarantees that the finger lever is retained in constant contact with the cam during the alternative coupling step, or that it is displaced into its top dead center position with the bearing block for the purpose of realizing further coupling steps. It is also conveivable to arrange this compression spring or another suitable pressurizing means between the finger lever and the bearing block.

A simple means of the invention for connecting the finger lever to the bearing block, and thus also indirectly to the column, is a pin. In place of the pin, it is also possible, according to the invention, to use a ball-and-socket joint or a rolling bearing connection.

The finger lever or the bearing block may be made of a light-weight material. This leads to an additional reduction of the oscillating mass of the valve drive which results in a reduction of friction work.

For the coupling of the finger lever in keeping with the first and second coupling steps, it is also possible to use separate coupling means. Thus, the finger lever can be positioned for its first coupling step with the help of separate locking elements. These can be, for instance, in the form of spacers, not specified, pushed under the bearing block. The finger lever of the invention can also be made as a cross-arm or a forked lever so that it then acts on more than one gas exchange valve at a time. It is likewise possible to integrate hydraulic clearance compensation means, not specified, into the device of the invention. To reduce friction and improve the wear resistance of the device as a whole, it is conceivable to apply a wear-resistant coating to the bores for the coupling piston or to use an additional bush of low-wear material. The compression spring can be dimensioned so that, in its "extended" state, it exerts no force on the device as a whole.

The invention is not limited solely to the features contained in the claims. Rather, combinations of individual features of the claims with one another and with the disclosures contained in the discussion of advantages and description of embodiments are both conceivable and intended.

BRIEF DESCRIPTION OF THE DRAWING

The above and other objects, features and advantages of the present invention will now be described in more detail with reference to the accompanying drawing, in which.

DETAILED DESCRIPTION OF PREFERRED EMBODIMENTS

Figure 1:
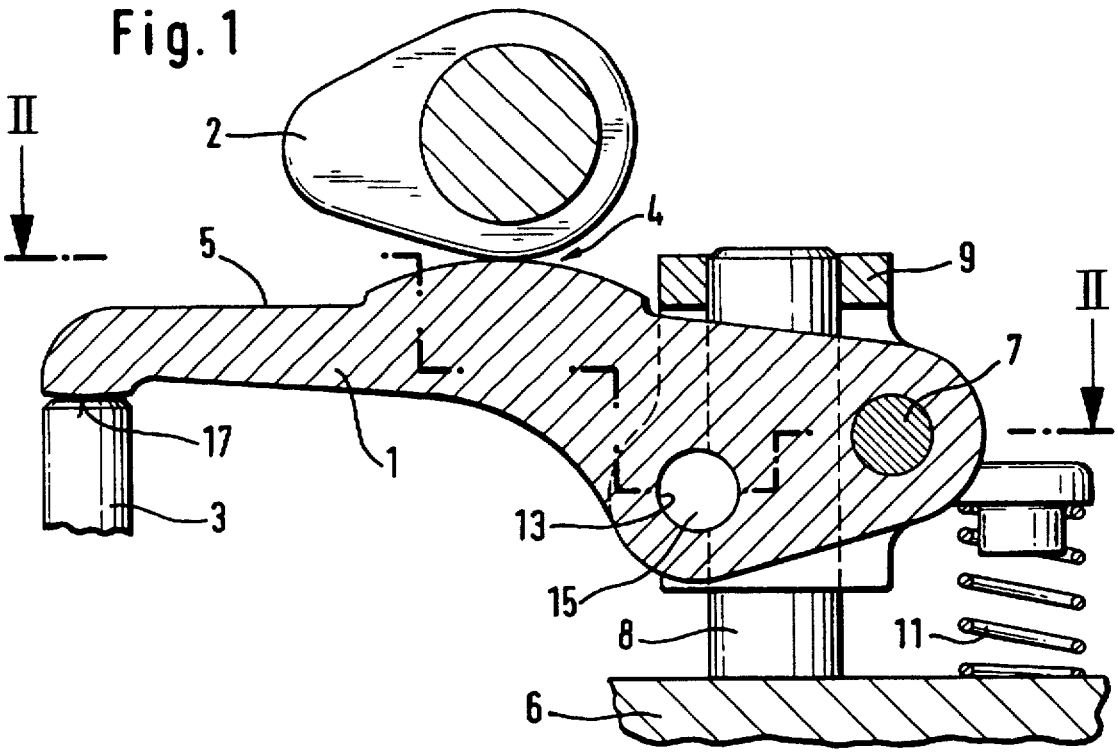
FIG. 1 is a longitudinal cross-section through a device of the invention taken along the sectional line II—II of FIG. 2.

FIG. 1 shows a finger lever 1 arranged in driving relationship between a control cam 2 of a camshaft and a gas exchange valve 3. The finger lever 1 is contacted by the control cam 2 preferably in a central region 4 of one of its end surfaces 5. At its end opposite the gas exchange valve 3, the finger lever 1 is pivoted on a cylinder head 6 of an internal combustion engine by a bearing member 7. A column 8 starting from the cylinder head 6 extends towards the cam. The finger lever 1 is connected by its bearing member 7 to a bearing block 9 which is longitudinally displaceable on the column 8. In this embodiment, the bearing member 7 is made as a pin.

Figure 2:
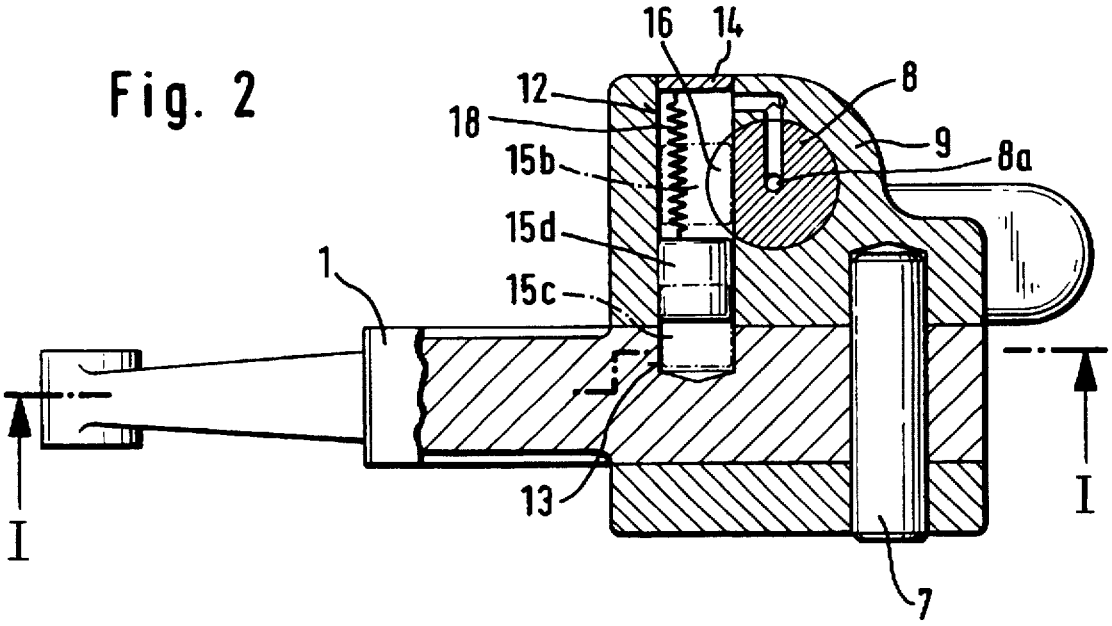
FIG. 2 is a top view of the device of the invention shown in FIG. 1, following the sectional line I—I of FIG. 1.

The bearing block 9 is biased towards the cam 2 by the force of a compression spring 11 supported on the cylinder head 6. As can be seen in FIG. 2, the bearing block 9 and the finger lever 1 each comprises a bore, 12 and 13 respectively. These bores 12, 13 are aligned to each other in one position of pivot of the finger lever 1 relative to the bearing block 9, preferably in a base circle phase of the cam. The bore 12 of the bearing block 9 is closed at one end by a plug 14, not specified. A coupling means in the form of a longitudinally displaceable piston 15 is arranged, as described below, to extend at different positions in the bores 12, 13 in the different operational states of the finger lever 1. This piston 15 is shown in FIG. 2 in its three coupling steps as indicated by reference numerals **15*b*, 15*c*, 15*d*. In a first coupling step, the piston 15*b* is arranged in the bore 12 of the bearing block 9 so that it extends simultaneously in a tangential groove 16 of the column 8. In this state, the finger lever 1 executes a maximum pivoting movement about its center of pivot on the bearing member 7**.

To accomplish a second coupling step, the piston **15*c* extends simultaneously in the bores 12 and 13 of the bearing block 9 and the finger lever 1. With this configuration, the finger lever 1 is displaced away from the cam 2 together with its bearing block 9 along the column 8 during the lift phase of the cam 2. The lifting stroke thus obtained on the gas exchange valve 3** is smaller than the stroke obtained in the first coupling step due to the different ratio of multiplication.

In an alternative coupling step, the piston **15*d* extends in an "idling space"in the bearing block 9 so that it is disengaged both from the tangential groove 16 of the column 8 and from the bore 13 of the finger lever 1. With this configuration, the finger lever 1, when contacted by the cam, executes a pivoting movement on its point of contact 17 (see FIG. 1) on the gas exchange valve 3. Since the force of the compression spring 11 which acts on the bearing block 9 in cam direction is smaller than the force of a closing means for the gas exchange valve 3, this latter remains closed. A change-over from one coupling step to another is preferably performed in a base circle phase of the control cam 2. Further variations of lift can be obtained, for example, by different tangential grooves 16 spaced along the length of the column 8. A control of the coupling piston 15 to move into the various coupling steps is effected in accordance with a nonlimiting example by hydraulic medium, which is part of the overall lubricant circulation system and conducted via a suitable passageway 8*a* from the cylinder head 6 into the working space above the piston 15. A tension spring 18 of suitable dimensions is placed in the working space between the plug 14 and the piston 15 to load the piston 15 in a direction toward the plug 14. Movement of the piston 15 into the various positions indicated at 15*b*, 15*c*, 15*d*** is effected by a suitable switching valve (not shown) which is part of a computerized engine management system that monitors such parameters as temperature, load or speed. The incorporation of such a hydraulic system is generally known to a person skilled in the art. It will also be appreciated by persons skilled in the art that even though the use of such hydraulic system to operate the piston is advantageous, the present invention is not limited thereto as the operation of the piston can also be effected in various other ways, e.g. mechanical, electro-mechanical, magnetic mechanisms. A re-positioning into at least one of the coupling steps can be effected by the force of at least one compression spring, not shown.

What is claimed is:

1. A finger lever assembly for a valve actuating mechanism of an internal combustion engine, comprising: a finger lever acted upon by a control cam having a single lift contour, said finger lever having one end acting on a gas exchange valve and another end; bearing means for swingably supporting the other end of the finger lever on a cylinder head, said bearing means including a longitudinal guide in general parallel relation to a longitudinal axis defined by the gas exchange valve, a bearing block slidably mounted on the longitudinal guide, and a bearing member for securing the finger lever to the bearing block; and a coupler for controlling actuation of the finger lever, said coupler being movable between a first position in which the bearing block is coupled with the longitudinal guide to effect during a lift phase of the control cam a maximum swinging action of the finger lever about the bearing member, a second position in which the bearing block is so linked to the finger lever as to conjointly execute an axial movement along the longitudinal guide during a complete cam lift, thereby effecting a smaller opening cross section of the gas exchange valve in the second position compared to the first position, and a third position in which the bearing block is disengaged from the longitudinal guide and the finger lever is disengaged from the bearing block so that the finger lever executes an idle swinging motion about the one end, with the gas exchange valve remaining in a closed state.

2. The finger lever assembly of claim 1 wherein the guide is formed by a column secured to the cylinder head and extending in a direction toward the cam, said bearing block and said finger lever each having a bore extending in parallel relation to the bearing member, with the bores of the bearing block and the finger lever being in alignment in a swinging position of the finger lever relative to the bearing block.

3. The finger lever assembly of claim 2 wherein the bores are in alignment in a base circle phase of the cam.

4. The finger lever assembly of claim 2 wherein the bore of the bearing block has a depth which corresponds at least to a length of the coupler so that an idling space is created for the coupler when occupying the third position.

5. The finger lever assembly of claim 2 wherein the column is formed with a recess which is engaged by the coupler when occupying the first position, whereby the coupler is positioned in the bore of the bearing block.

6. The finger lever assembly of claim 1, and further comprising pressurizing means extending between the bearing block and the cylinder head for loading the bearing block in direction toward the cam.

7. The finger lever assembly of claim 6 wherein the pressurizing means is a compression spring exhibiting a spring force which is smaller than a force applied by a pressure-exerting member which loads the gas exchange valve in a closing direction.

8. The finger lever assembly of claim 1 wherein the bearing member is a pin.

9. The finger lever assembly of claim 1 wherein at least one member selected from the group consisting of finger lever and bearing block is made of a material selected from the group consisting of lightweight material and polymer material.

* * * * *